United States Patent [19]

Rosen

[11] 4,319,704

[45] Mar. 16, 1982

[54] SUPPORT MEMBER

[76] Inventor: Louis M. Rosen, 7 E. 14th St., New York, N.Y. 10003

[21] Appl. No.: 198,835

[22] Filed: Oct. 20, 1980

[51] Int. Cl.[3] ..... A45F 5/00

[52] U.S. Cl. ..... 224/270; 224/269; 224/907

[58] Field of Search ..... 224/270, 269, 271, 163, 224/907, 45 Q, 45 N, 46 R

[56] References Cited

U.S. PATENT DOCUMENTS

| | | | |
|---|---|---|---|
| D. 203,101 | 12/1965 | Holder et al. | 224/270 X |
| 947,024 | 1/1910 | Paine et al. | 224/907 X |
| 3,200,536 | 8/1965 | Petitto, Sr. | 224/269 X |
| 3,285,482 | 11/1966 | Bedsaul, Sr. | 224/269 X |

FOREIGN PATENT DOCUMENTS

| | | | |
|---|---|---|---|
| 10111 | of 1889 | United Kingdom | 224/270 |
| 1416278 | 12/1975 | United Kingdom | 224/270 |

*Primary Examiner*—Steven M. Pollard

*Attorney, Agent, or Firm*—Kenyon & Kenyon

[57] ABSTRACT

A support member adapted to be worn on a person's belt to assist in supporting bulky or heavy packages is disclosed. The support member includes an upper roughened surface for supporting the package which surface is inclined upwardly in a direction away from the wearer's body. Extending downwardly from the inner portion of the supporting surface is a generally vertical member which includes therein a slotted portion suitable for engagement with the wearer's belt. Disposed below the slotted vertical member is a body engaging surface which bears against the person's body when a package is being supported on the upper inclined surface of the support member.

3 Claims, 4 Drawing Figures

SUPPORT MEMBER

This invention relates to a support member and in particular to one for supporting large or heavy packages to be carried by a person.

Frequently, shoppers encounter situations in which they are compelled to carry large, buiky or heavy packages. While shopping, for instance in supermarkets, carts are provided to a shopper in which the goods being purchased are placed. However, once the supermarket area is left, the shopper is required to either carry home large packages or carry them to an automobile. These packages are frequently heavy, bulky and otherwise difficult to transport; moreover, in certain instances they must be carried for great distances. This presents a particularly severe problem for elderly and handicapped people.

SUMMARY OF THE INVENTION

It is an object of the present invention to provide a support member suitable for engagement on a person's belt and adapted to support large, bulky and heavy items.

It is another object of the present invention to provide a light-weight support member upon which a person may position a package being carried and which is easy to insert and remove by the user.

These and other objects of the present invention are achieved in accordance with the disclosed invention in which a support member having a roughened upper surface is provided upon which a package may be supported. Depending downwardly from the supporting surface is a belt engaging means and a member disposed therebeneath for bearing against the wearer's body in order to provide a load bearing surface to counter the weight of the package being carried.

In the disclosed embodiment, the upper surface or package engaging surface is inclined upwardly in a direction away from the wearer's body approximately 10° from a horizontal plane. The degree of inclination is sufficient such that when the package is supported thereon, the surface assumes a generally horizontal supporting position. The support member is formed in a generally L-shaped section with the vertical depending portion including a slotted means therein. The open end of the slotted means is disposed at the lowermost portion of the vertical section to facilitate insertion onto a person's belt. a body engaging section is provided which extends downwardly from the vertical portion of the L-shaped section. The body engaging section has the inner body bearing surface thereof disposed inwardly of the inner surface of the vertical section and may include a cushioned portion to eliminate any undue pressure on the body of the user. The body engaging section extends below the slotted portion of the vertical section and is substantially wider than that of the upper package supporting surface.

These and other objects of the invention will be more apparent from the following description of an embodiment thereof when considered along with the accompanying drawings and appended claims.

DESCRIPTION OF THE PREFERRED EMBODIMENT

Figure 1:
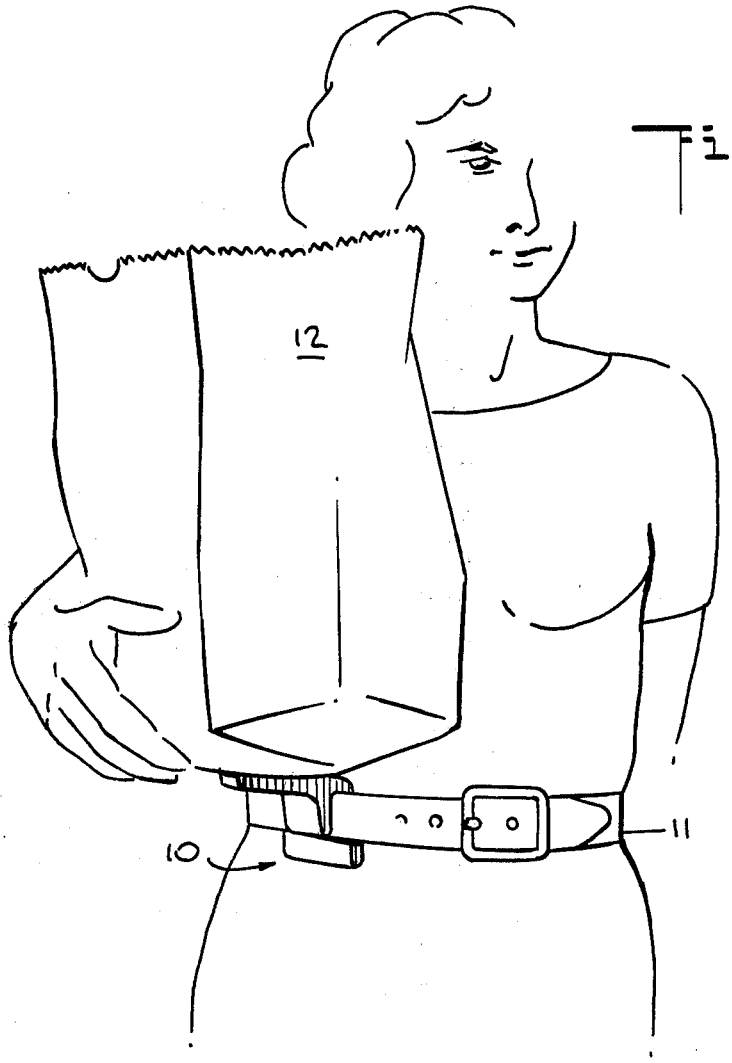
FIG. 1 is a perspective view of a person wearing a support member according to the present invention.

Referring to the drawings, and in particular to FIG. 1, the support member denoted generally as 10 is mounted on a belt 11 worn by a person carrying a package 12. The support member 10 in essence forms a hip extension upon which the package 12 rests so as to better distribute the load on the person utilizing the support member.

Figure 3:
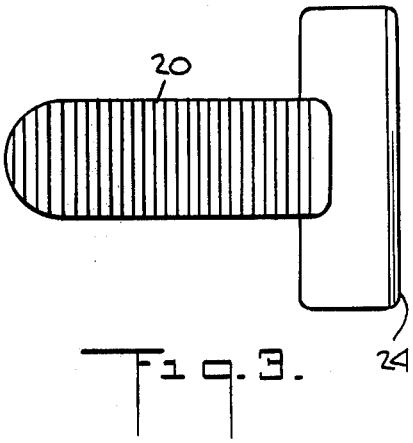
FIG. 3 is a plan view of the support member of the present invention.
Figure 4:
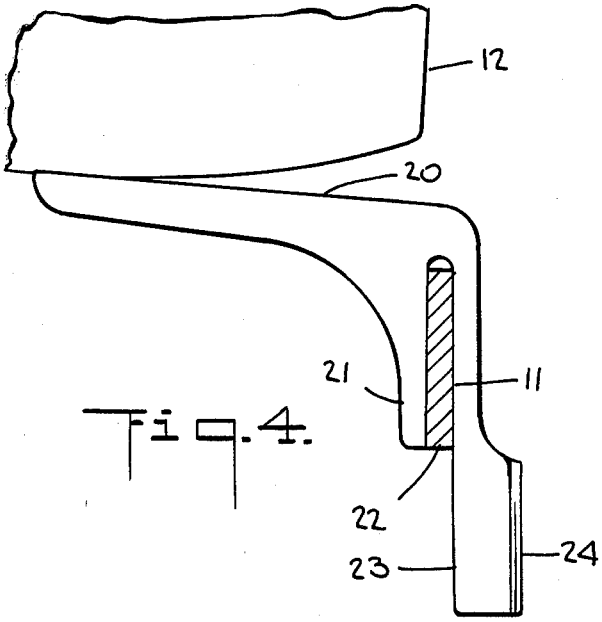
FIG. 4 is a side elevation view, partly in cross-section, of the support member of the present invention.
Figure 2:
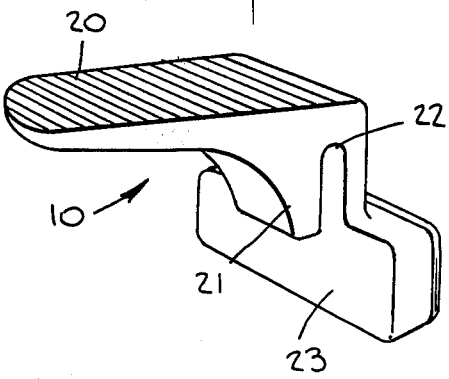
FIG. 2 is a perspective view of the support member of the present invention.

With reference to FIGS. 2–4, support member 10 includes a substantially flat extension surface 20 which is preferably roughened so as to provide frictional engagement with the package 12 being carried. The support member 10 is preferably molded from a light weight plastic material and may include a tread like section on the extension surface 20. Alternatively, a rubberized or other form of roughened surface may be substituted. Depending downwardly from surface 20 is a generally vertical section 21 which includes a slotted portion 22 therein. the slotted portion 22 is adapted to be inserted over the user's belt 11. The upper package engaging surface 20 is inclined upwardly in a direction away from the body of the wearer approximately 10°.

A body engaging portion 23 depends downward from the inner portion of vertical section 21 and is disposed below the lower portion of slotted member 22. A compressible material 24 in the form of an expanded rubber may be placed on the inner body bearing surface of member 23 in order to cushion any force exerted against the wearer's body. Alternatively, the entire body engaging section 23 may be made of a compressible material, such as foam rubber, which is preferably compressible by approximately 30% of its original thickness. Body engaging member 23 is substantially wider than that of the package engaging surface 20 so as to more evenly distribute the load against the body of the wearer.

As mentioned, the upper package engaging surface 20 of the generally L-shaped support member 10 is inclined upwardly approximately 10° from a horizontal plane. In this manner, when a package is positioned on support surface 20, a force is exerted against the body of the user by way of the body engaging member 23. It has been found that the inclination so provided will generally permit the package engaging surface 20 to assume a generally horizontal position in the loaded state and thus be rendered most effective for supporting the package. In any event, it is desirable that the surface 20 not become downwardly inclined away from the wearer in the loaded state which would tend to allow the package to slip or slide off the supporting member.

By the means disclosed herein, a light weight support member is provided which is sufficiently small in size to be readily carried by a user in a pocket or purse. Utilization of the support member of this invention on a person's belt provides great assistance in supporting large or heavy packages particularly when they must be carried for great distances.

The advantages of the present invention, as well as certain changes and modifications of the disclosed embodiment thereof will be readily apparent to those skilled in the art. It is the applicant's intention to cover by his claims all those changes and modifications which could be made to the embodiment of the invention herein chosen for the purpose of the disclosure without departing from the spirit and scope of the invention.

What is claimed is:

1. A package support member suitable for engagement with a person's belt to assist in supporting large or heavy packages which comprises an upper substantially flat extension surface for engaging and supporting the package, said substantially flat extension surface being upwardly inclined with respect to a horizontal plane in the unloaded state, the angle of inclination being sufficient to allow said upper surface to assume a substantially horizontal position in the loaded state;

a generally vertical section depending downwardly from the inward end of said upwardly inclined upper extension surface, said vertical section including on the forward face thereof a generally U-shaped slotted opening having the open end thereof disposed at the lowermost portion of said vertical section to facilitate engagement of said support on a person's belt, and a body engaging section having associated therewith a compressible surface adapted to evenly distribute the load of the package against the body of the wearer.

2. A package support as defined in claim 1 wherein said substantially flat extension surface has the package engaging portion thereof roughened so as to provide frictional engagement with the package being supported.

3. A package support as defined in claim 1 wherein said substantially flat extension surface is upwardly inclined approximately 10° with respect to the horizontal plane.

* * * * *